US007757798B2

(12) United States Patent
Niemeier

(10) Patent No.: US 7,757,798 B2
(45) Date of Patent: Jul. 20, 2010

(54) FORK LIFT TRUCK

(75) Inventor: Karlheinz Niemeier, Norderstedt (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 203 days.

(21) Appl. No.: 11/960,983

(22) Filed: Dec. 20, 2007

(65) Prior Publication Data

US 2008/0245620 A1 Oct. 9, 2008

(30) Foreign Application Priority Data

Apr. 4, 2007 (DE) ..... 20 2007 004 984 U

(51) Int. Cl.
*B62D 23/00* (2006.01)

(52) U.S. Cl. ..... 180/89.1; 187/222; 187/401; 296/190.01; 296/190.08

(58) Field of Classification Search ..... 180/89.1, 180/315; 188/222; 296/190.01, 190.08
See application file for complete search history.

(56) References Cited

U.S. PATENT DOCUMENTS 3,027,961 A * 4/1962 Rogant ..... 180/315
3,722,613 A * 3/1973 De Priester et al. ..... 180/21
3,756,350 A * 9/1973 Gandolfo et al. ..... 187/222
6,089,353 A * 7/2000 Bartels et al. ..... 187/224
6,137,398 A * 10/2000 Dunlap et al. ..... 340/439
6,182,778 B1 * 2/2001 Henshaw et al. ..... 180/89.12
6,189,964 B1 * 2/2001 Henshaw et al. ..... 297/112
6,236,927 B1 * 5/2001 Sherman ..... 701/70
6,293,364 B1 * 9/2001 Anderson et al. ..... 180/312
7,156,200 B2 * 1/2007 Dershem et al. ..... 180/311
7,246,846 B2 * 7/2007 Shioji et al. ..... 296/190.11
2005/0269142 A1 12/2005 Herschel
2006/0103128 A1 * 5/2006 Frechet et al. ..... 280/785
2007/0182121 A1 * 8/2007 Kraimer et al. ..... 280/166

* cited by examiner

*Primary Examiner*—Lesley Morris
*Assistant Examiner*—James English
(74) *Attorney, Agent, or Firm*—Vidas, Arrett & Steinkraus

(57) ABSTRACT

Fork lift truck comprising a drive unit and a load unit which may be raised and lowered relative to the drive unit, the drive unit having a fixed operator's platform which may be accessed via a rear entrance, from where steering, controlling the drive motor and actuating the load unit may be operated, the operator's platform being defined by side walls and being fastened to the frame of the drive unit, on the frame a lower wall portion of the side walls being configured, which is formed integrally with the frame or is welded to the frame and an upper wall portion is formed with its lower edge which is complementary to the upper edge of the lower wall portion and may be releasably connected by means of screw connections to the frame and/or the lower wall portions.

6 Claims, 1 Drawing Sheet

FORK LIFT TRUCK

CROSS-REFERENCE TO RELATED APPLICATIONS

Figure 1:
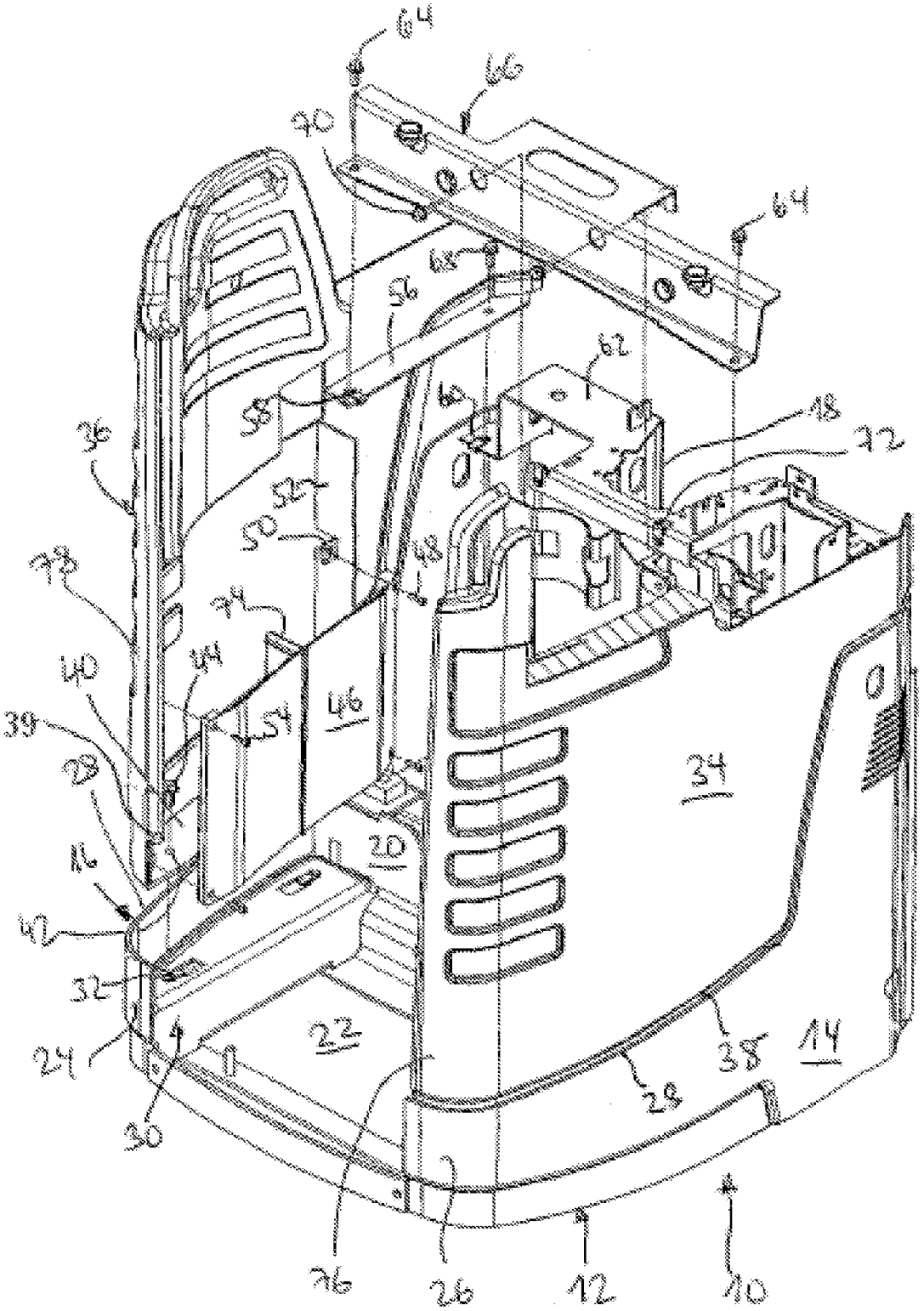

Not applicable.

STATEMENT REGARDING FEDERALLY SPONSORED RESEARCH

Not applicable.

BACKGROUND OF THE INVENTION

In tiller-controlled fork lift trucks a differentiation is made between pedestrian lift trucks and rider lift trucks. In rider lift trucks, a differentiation is also made between those which have an operator's platform which may be folded out to the rear and those which have a fixed operator's platform. In the last-mentioned case, an entrance is formed at the rear end of the lift truck and the operator's platform is laterally defined by side walls. The side walls may be provided with padding in order to soften impacts.

In lift trucks of the aforementioned type, a differentiation is made between the load unit and the drive unit. The load unit has wheel arms which are spaced apart in parallel and which are fixedly connected to the load unit. By means of a lifting device in the drive unit, the load unit may be raised to a specific degree. With battery-driven lift trucks, the battery is generally located in the load unit and is therefore also raised therewith. Located in the drive unit are all the units which are required for operating the lift truck, in particular the drive motor, hydraulics for the lifting device and optionally a steering motor for power assistance when steering with the tiller. Said units are accommodated in front of the operator's platform in a front compartment of the drive unit. A cover provides the delimitation which extends to an upper panel in which individual operator controls are provided for the lift truck.

The object of the invention is to provide a fork lift truck with a fixed operator's platform, which permits simpler assembly in particular of the aforementioned units, allows easier access to the units for maintenance purposes and simplifies the painting process.

BRIEF SUMMARY OF THE INVENTION

In the fork lift truck according to the invention, lower wall portions for side walls are configured on the frame, which are either integrally formed with the frame or welded onto the frame. Upper wall portions are formed with a lower edge which is complementary to the upper edge of the lower wall portions and releasably connected by means of screw connections to the frame and/or the lower wall portions.

In contrast to the prior art in which the side walls are welded to the frame, side wall portions are provided which may be fitted on and which may be attached by screw connections during assembly and which may also be removed again for assembly purposes.

The construction according to the invention has a plurality of advantages. If the outer surface of the industrial truck is painted in two colours, for example such that load-bearing parts are provided with a first colour and non-load-bearing parts are provided with a second colour, painting in two colours may be more easily carried out, as each component, namely the frame on the one hand and the upper side wall portions on the other hand, may be painted separately. A further advantage is produced during the final assembly of the fork lift truck. The units in the drive unit may be assembled in a manner which is easily achievable in terms of ergonomics without awkward upper side wall portions. By removing the upper side wall portions, easy access to the units in the drive unit may also be obtained for repair and maintenance purposes.

According to an embodiment of the invention, the operator's platform is attached to the frame and/or to the lower wall portions. Shoulders or steps are provided to the side on the operator's platform, on which a base portion of the upper wall portions is arranged vertically and fastened thereto. The upper face of the shoulders and/or steps is located expediently below the upper edge of the lower side wall portions, whereby the lower side wall portions partially cover the upper side wall portions when the base of the upper side wall portions is placed on the steps.

According to a further embodiment of the invention, the side wall portions at the rear end have a wall portion which is bent back toward the rear entrance. On the lower inner face of the upper side wall portions, a plate (for example made of plastics) is attached at a distance from the side wall portions by a screw connection, which forms a cladding of the side wall portion. As a result, when climbing down, a foot of the operator is prevented from becoming caught behind the bent-back portions, resulting in the risk of an accident for the operator. The plate may, moreover, form receiving pockets for receiving planar and/or elongate parts.

For the purposes of stabilization, according to a further embodiment of the invention a cross-member may be provided which connects the upper side wall portions to one another, the arrangement of the cross-member being such that it does not hinder the operator on the operator's platform.

The invention is to be described in more detail hereinafter with reference to an embodiment.

BRIEF DESCRIPTION OF THE DRAWING OF THE INVENTION

FIG. 1 shows the drive unit of a fork lift truck according to the invention, in perspective and partially in exploded view.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated A drive unit 10 for a fork lift truck is shown in the only FIGURE, the load unit with load wheel arms not being shown. The individual units for actuating the lift truck, which are accommodated in the drive unit 10, such as the drive motor, the lifting device for the load unit and optionally the steering motor for the tiller steering of the industrial truck are not shown, nor is the tiller for steering the lift truck. Said parts are generally known, so that it is unnecessary to go into more detail.

The drive unit 10 has a frame 12 which is connected to lower side wall portions 14 and/or 16. The side wall portions 14, 16 are connected to a front wall 18 toward the front end, on which for example the lifting device is attached. The side wall portions 14, 16 are connected to one another by an upright wall 20, which separates an operator's platform 22 from the region in which the aforementioned units are accommodated, i.e. in the case of the FIGURE on the front side of the wall 20. The side wall portions 14, 16 are fixedly welded to a lower frame part or form, in turn, the frame for the drive unit 10. At a rear entrance to the operator's platform 22 they comprise inwardly curved wall portions 24 and/or 26. Toward the front region the lower side wall portions 14, 16 are raised, so that a reverse Z-shaped upper edge 28 results. On both sides of the operator's platform 22 steps 30 are provided which are formed from bent sheet metal and adjoin the inner face of the lower side wall portions 14, 16 as well as the curved wall portions 24, 26 and/or the intermediate wall 20. Into the upper surface of the steps 30, of which in the FIGURE only one may be seen, so-called clip nuts 32 are introduced.

The upper side wall portions 34 and/or 36 have a lower edge 38 which is complementary to the upper edge 28 of the lower side wall portions 14, 16, between said edges a visual groove 39 being formed. The upper side wall portions overlap the lower side wall portions in the region of the edge 28.

As may be seen relative to the upper side wall portion 36, the side wall portions 34, 36 have a base 40 at the lower end. With the base 40, the upper side wall portions 34, 36 are placed onto the upper face of the steps 30. As a result, lower and upper side wall portions are overlapped such that the edge 28 and 38 forms the aforementioned visual groove 39. The base portion 40 comprises two holes 42, as a result of which the side wall portions 34, 36 may be screwed to the steps 30 by means of screws 44.

A plate made of plastics is screwed on the inside to the lower side wall portions 14, 16 at a distance by means of screws 48. The screws are located in nuts 50 which are formed and/or attached to a web 52 which is connected to the inner face of the upper side wall portions 34, 36. In the region of the entrance, the plate 46 is fixedly connected above and below by means of screws 54 to the inner face of the upper side wall portions 34, 36. In this manner, a fixed screw connection to the frame and/or the lower side wall portions 14, 16 is achieved.

In addition to the vertical web 52, in the front upper region on the inner face of the upper side wall portions 34, 36, a horizontal web 56 is attached with a front screw hole and a rear clip nut 58. A further clip nut 60 is located in a horizontal connecting metal plate 62 which is bent back from the front wall 38 and is used for receiving the screws 68. The screws 64 are passed through screw holes of a cross-member 66, for the purpose of fastening the cross-member to the horizontal web 56. Before the cross-member 66 is fastened, by means of the screws 68 a connection of the horizontal web 56 to the upper connecting portion 62 is produced via the clip nuts 60 thereof. In this manner, a further screw connection of the upper side wall portions 34, 36 to the frame of the drive unit 10 is achieved. The cross-member 66 which is subsequently attached stabilizes the upper side wall portions 34, 36.

It should also be mentioned that for representational reasons, the upper rear part is removed from the upper side wall portion 34, in order to allow an improved view into the inside of the drive unit 10.

Screws 70 are used to fasten the cross-member 66 via clip nuts 72 in the horizontal transverse connecting part 62.

The plate 46 forms two upwardly open pockets for receiving objects, the pockets being divided by a vertical web 74, via which the plate 46 is supported on the inner face of the upper side wall portion 34 and/or 36.

The upper side wall portions 34, 36 also have wall portions 76, 78 curved toward the entrance, which are aligned with the curved wall portions 24, 26. The operator's platform 22 may accommodate a plate, a mat or the like, in order to transfer impacts and vibrations in a dampened manner to the feet of the driver and/or operator.

The installation of the units, not shown, in the region of the drive unit 10 on the front side of the transverse wall 20 takes place before the upper side wall portions 34, 36 are assembled. They may, therefore, be attached in a simple manner without difficulty. The upper side wall portions 34, 36 are subsequently screwed together. If said upper side wall portions are provided with a different colour from, for example, the lower side wall portions 14, the side wall portions may be painted separately in a correspondingly different manner.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. Fork lift truck comprising a drive unit and a load unit raised and lowered relative to the drive unit, the drive unit having a fixed operator's platform accessed via a rear entrance, from where steering and controlling of a drive motor and actuating of the load unit operated, the operator's platform being defined by side walls and being fastened to a frame of the drive unit, wherein on the frame (12), a lower wall portion (14, 16) of the side walls is configured, which is formed integrally with the frame (12) or is welded to the frame (12) and an upper wall portion (34, 36) is formed with its lower edge (38) which is complementary to an upper edge (28) of the lower wall portion (14, 16) and releasably connected by means of screw connections to the frame (12) and/or the lower wall portions (14, 16), wherein the operator's platform (22) is attached to the frame (12) and/or to the lower wall portions (14, 16), using the screw connections, and steps (30) are arranged to the side on the operator's platform (22), on which a base portion (40) of the upper wall portions (34, 36) stands vertically and is fastened, and wherein the steps (30) are formed from separate sheet metal blanks which are fixedly connected to the frame (12) and/or the lower side wall portions (14, 16).

2. Fork lift truck according to claim 1, wherein at least the upper side wall portions (34, 36) at the rear end have a wall portion (76, 78) which is bent back toward the rear entrance, and on a lower inner face of the upper side wall portions (34, 36) a plate (46) is attached at a distance from the upper side wall portion (34, 36) by screw connections, which inwardly dads the upper side wall portion (34, 36).

3. Fork lift truck according to claim 2, wherein the plate (46) forms with the base portion (40) and the side wall portion (34, 36) an upwardly open pocket.

4. Fork lift truck according to claim 1, wherein the upper side wall portions (34, 36) are releasably connected to one another by means of an upper cross-member (66).

5. Fork lift truck according to claim 1, wherein the lower side wall portions (14, 16) at least in the rear region slightly overlap the upper side wall portions (34, 36).

6. Fork lift truck according to claim 5, wherein the overlapping portions of the upper side wall portions (34, 36) are inwardly offset relative to the lower side wall portions.

* * * * *